United States Patent [19]

Nakamoto et al.

[11] Patent Number: 4,941,149

[45] Date of Patent: Jul. 10, 1990

[54] METHOD OF MELTING AND/OR REFINING METALS AND COOLING DEVICE FOR THE GRAPHITE ELECTRODE USED FOR THE SAME

[75] Inventors: Yakka Nakamoto, Tokyo; Toshihiko Mori, Toyama, both of Japan

[73] Assignee: Nippon Carbon Co., Ltd., Tokyo, Japan

[21] Appl. No.: 231,819

[22] PCT Filed: Jun. 24, 1987

[86] PCT No.: PCT/JP87/00415

§ 371 Date: Aug. 15, 1988

§ 102(e) Date: Aug. 15, 1988

[87] PCT Pub. No.: WO88/07315

PCT Pub. Date: Sep. 22, 1988

[30] Foreign Application Priority Data

Mar. 17, 1987 [JP] Japan ..... 62-063304

[51] Int. Cl.[5] ..... H05B 7/12

[52] U.S. Cl. ..... 373/96

[58] Field of Search ..... 373/95, 96

[56] References Cited

FOREIGN PATENT DOCUMENTS 1167992 4/1964 Fed. Rep. of Germany ..... 373/95
220776 4/1985 German Democratic Rep. .
59-51496 4/1984 Japan .
59-101198 7/1984 Japan .
1035838 8/1983 U.S.S.R. .
1125787 11/1984 U.S.S.R. ..... 373/95
29259 of 1914 United Kingdom ..... 373/95

*Primary Examiner*—Roy N. Envall, Jr.
*Attorney, Agent, or Firm*—Sughrue, Mion, Zinn, Macpeak & Seas

[57] ABSTRACT

A method for melting and/or refining metals and a cooling device for the graphite electrode used for the same are disclosed. Melting and/or refining of metal such as steel-making are performed in an electric arc furnace by energizing three graphite electrode sets each corresponding to each phase of a three-phase AC power source and consisting of a vertical succession of graphite electrodes as typically shown at 10 in FIGS. 2, 3 and 4, connected to one another via nipples.

During the melting and/or refining of metal, a cooling liquid 11, substantially consisting of water for instance, is continuously blown against the outer periphery 10*a* of at least one of each set of graphite electrodes, specifically a graphite electrode 10 extending between an electrode holder and a furnace top cover. The liquid coolant 11 is jet not in the horizontal direction but in a downwardly or upwardly inclined direction at an angle of 10° to 35° C. with respect to the horizontal.

10 Claims, 7 Drawing Sheets

METHOD OF MELTING AND/OR REFINING METALS AND COOLING DEVICE FOR THE GRAPHITE ELECTRODE USED FOR THE SAME

TECHNICAL FIELD

This invention relates to a method of melting and/or refining metals and a cooling device for the graphite electrode used for the same and, more particularly, to a method of melting and/or refining metals and a cooling device for the graphite electrode used for the same, in which, during melting and/or refining of a metal in an electric arc furnace by passing current through graphite electrodes connected to one another via nipples, a coolant, e.g., cold water, is blown continuously against the outer periphery of upper graphite electrodes held by an electrode holder to cool the electrodes, particularly, it is blown in a downwardly inclined direction at an angle of 10° to 35° C. with respect to the horizontal to minimize its spattering as it is blown and effectively cool the electrodes, as well as suppressng wear of the electrode outer periphery due to oxidization, improving the life of the cover of the electric arc furnace and permitting high voltage or high power factor operation.

BACKGROUND TECHNIQUES

In the steel-making and electric arc melting and/or refining of metals, it has been desired to reduce electric energy cost and wear of the end of outer periphery of graphite electrodes due to oxidation, thereby reducing the cost for electrodes. For suppressing the wear due to oxidization, it has been proposed and practiced to cool graphite electrodes. For the cooling of graphite electrodes in the refining of metal, for instance, there have been proposed a method and a device, in which of graphite electrodes which are connected successively upper ones are constructed such that their inside is cooled by cooling water, that is, they are constructed as water-cooled non-consumable electrodes, and only the remaining lower graphite electrodes which are connected via nipples to the lower end of and cooled from the non-consumable electrodes are consumed during melting and/or refining operations. For example, U.S. Pat. Nos. 4,416,014, 4,417,344 and 4,451,926 disclose structures, in which water-cooled non-consumable electrodes consist of hollow aluminum cylinders, and cooling water is introduced into these non-consumable electrodes to cool the wall surface thereof and graphite electrodes to cool the wall surface thereof and graphite electrodes connected to the lower end of these non-consumable electrodes.

Further, Japanese Patent Disclosures 501879/1985 and 501880/1985 disclose structures, in which water-cooled non-consumable electrodes consist of graphite pipes, and cooling water is introduced into the bore of these non-consumable electrodes.

Where the upper non-consumable electrodes are cooled to cool the lower graphite electrodes are connected thereto, wear of the end and outer periphery of the graphite electrodes due to oxidization can be suppressed to attain reduction of the cost for the electrodes.

However, when the graphite electrodes connected to the lower end of the non-consumable electrodes are worn out so that they are to be removed, the electrodes set has first to be removed from the electric arc furnace and transferred to an off-line before removing then from nipples and also removing, if necessary, the nipples from the non-consumable electrodes. When connecting new graphite electrodes, the nipples are first connected to the non-consumable electrodes, and then the new consumable electrodes are connected to the nipples. In this way, in the system where the lower consumable graphite electrodes are cooled from the upper water-cooled non-consumable electrodes, the replacement of worn-out lower consumable graphite electrodes requires works of transferring the electrodes set to the off-line and hard off-line labors of removing and connecting electrodes and nipples. These works and labors are very cumbersome. Further, if the removal and reconnection of consumable graphite electrodes are done repeatedly, it will lead to deformation or battering of and damage to the consumable and non-consumable electrodes and nipples, defectiveness of connection of electrodes and increase of the electric resistivity. In such cases, normal operation of melting and/or refining of metal will be impeded.

To solve the above problems, there has been proposed a cooling system, which does not use any water-cooled non-consumable electrode for cooling lower consumable electrodes graphite electrodes connected thereto. More specifically, Japanese Utility Model Publication 23,357/1984 discloses a cooling device, in which cooling water is blown against the surface of a graphite electrode extending upwardly from the cover of an electric arc furnace. This cooling device is as shown in FIG. 1. In the Figure, reference numeral 1 designates the cover of the electric arc furnace. A graphite electrode 2 vertically movably penetrates the cover 1, and a lower graphite electrode is connected to the lower end of this graphite electrode 2. The lower graphite electrode extends in the electric arc furnace to effect metal refinement, e.g., steel-making. Above the cover 1, an upper end portion of the graphite electrodes 3 is held by an electrode holder 3. The electrode holder 3 is provided at the bottom with a ring-like cooling ductline 4. The ductline 4 has a plurality of downwardly extending vertical pipes 5, which are in turn provided with nozzles 6 directed toward the graphite electrode surface. Cooling water supplied to the ring-like ductline 4 descends along the vertical pipes 5 to be blown out from the nozzles 6 against the outer periphery of the graphite electrode for the cooling thereof.

In the cooling device shown in FIG. 1, however, cooling water is jet from each nozzle 6 in the horizontal direction. Therefore, when it strikes the outer periphery of the graphite electrode 2, a considerable quantity of it is spattered. Because of the great quantity of spattered cooling water, the electrode holder 3 and cover 1 are subject to serious contamination and damage, so that the cooling device is practically infeasible. Further, since only a slight proportion of the jet cooling water contributes to the cooling, it is necessary to use an extraordinarily great quantity of cooling water, which is undesired very much in view of the economy. Still further, a plurality of vertical pipes 5 extends downwardly to a very large extent from the ring-like cooling ductline 4. These long vertical pipes 5 constitute an obstacle when removing the cooling device for replacement of electrodes, that is, they dictate very cumbersome works for the electrode replacement.

The cooling device shown in FIG. 1 has a yet further drawback. Since the ring-like cooling ductline 4 is provided such that it surrounds the outer periphery of the graphite electrode 2, it shields electromagnetic forces to cut off a considerable portion of current passed through the graphite electrode 2. This presents serious problems in the operation of the electric arc furnace. Usually, for its operation an electric arc furnace uses three graphite electrodes in correspondence to a three-phase AC power source. For cooling these graphite electrodes, the cooling device as shown in FIG. 1 is provided for each of them. Since each cooling ductline 4 is ring-like, the individual graphite electrodes 2 are mutually electromagnetically influenced by one another. Meanwhile, since each cooling ductline 4 shields electromagnetic forces, current through each graphite electrode 2 is cut off. Therefore, the electrode consumption is greatly increased to obtain sufficient heating of metal.

DISCLOSURE OF THE INVENTION

The present invention concerns a method of melting and/or refining metals, in which a liquid coolant is blown not in the horizontal direction at an angle of 10° to 35° C. with respect to the horizontal. Therefore, when the coolant strikes the outer periphery of the graphite electrode, it does not substantially spattered, but its major proportion flows down the graphite electrode outer periphery to in the form of a film. The graphite electrode outer periphery is cooled by this film of liquid coolant. The cooling is not limited to a local portion of the graphite electrode outer periphery, that is, a portion of the graphite electrode outer periphery having a greater length is cooled and held black, thus greatly, reducing the wear of graphite electrodes connected to one another due to oxidization thereof.

According to the invention, water containing or not containing an oxidization resistant agent is used as liquid coolant. Therefore, as the coolant flows down the graphite electrode outer periphery, the oxidation resistant agent, if it is contained, is attached thereto to form an oxidization resistant agent film, thus effectively preventing the wear of the graphite electrodes due to oxidization thereof.

Further, according to the invention the liquid coolant is blown against under a jet pressure of 0.5 to 3 kg/cm$^2$ and at a rate of 0.8 to 6.0 l/min. If the liquid coolant is blown under these conditions, it will not be substantially spattered as it is blown against, but its major proportion flows down the graphite electrode outer periphery. Even if it enters the furnace, it is instantly evaporated, so that it poses no problem in the operation of the furnace.

Still further, according to the invention ring-like cooling ductline is provided around graphite electrode between the cover of an electric arc furnace and electrode holder holding an upper end portion of the graphite electrode succession, and it is provided with a plurality of jet nozzles directed toward the graphite electrode outer periphery for blowing the liquid coolant thereagainst. This ring-like cooling ductline has a gap formed by removing at least a portion of it. Therefore, even if the cooling ductline is subject to the electromagnetic influence of the current through the graphite electrode, no current is caused to flow through the cooling ductline owing to the gap thereof, that is, current through the graphite electrode is never cut off. Further, at least one jet nozzle provided in the ring-like cooling ductline has an outlet such that the liquid coolant jet therefrom is directed toward in a direction toward the graphite electrode axis and at a downward or upward angle of 10° to 35° C. with respect to the horizontal. Therefore, as the liquid coolant jet from this jet nozzle strikes the graphite electrode outer periphery, it is not substantially spattered, but its major proportion flows down the outer periphery to form a liquid coolant film thereon. The outer periphery of graphite electrode succession held by the electrode holder, thus can be cooled uniformly over its entire length. It is thus possible to greatly reduce the electrode consumption.

BEST FORMS OF CARRYING OUT THE INVENTION

Figure 1:
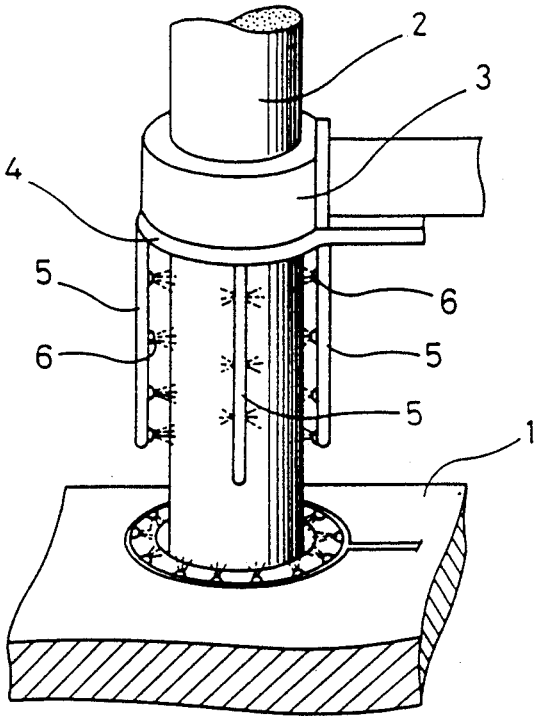
Fig. 1 PRIOR ART
FIG. 1 is a perspective view showing a prior art cooling device.
Figure 2:
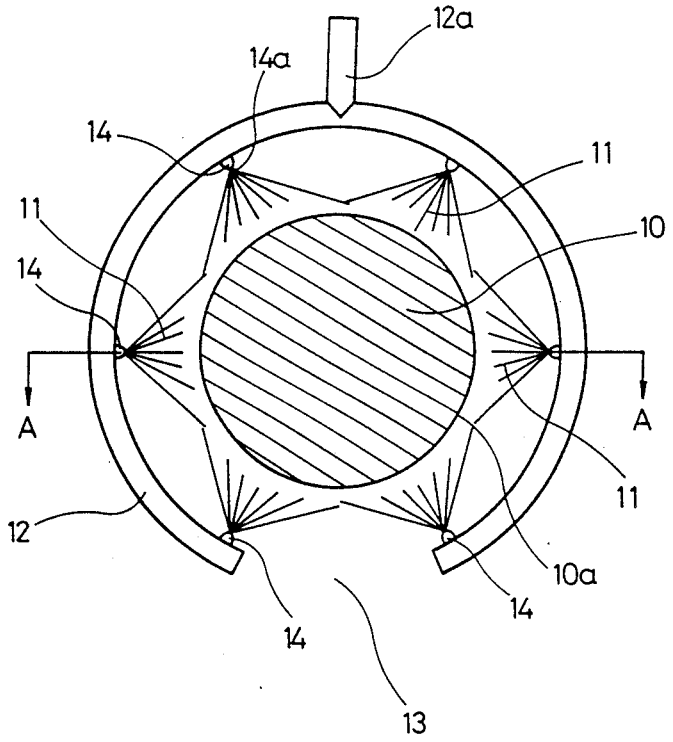
FIG. 2 is a plan view showing a cooling device according to the invention used for cooling graphite electrodes.
Figure 3:
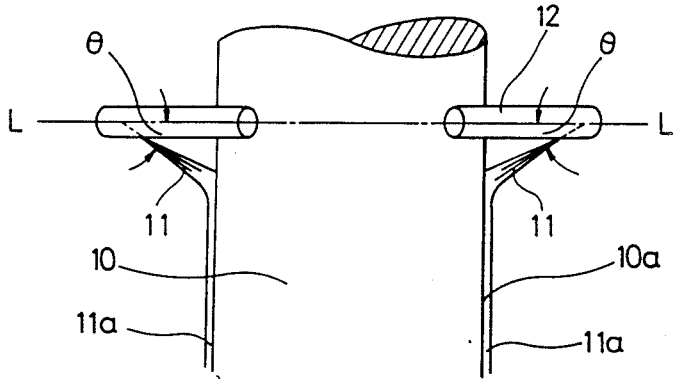
FIG. 3 is a front view showing the cooling device shown in FIG. 2.
Figure 4:
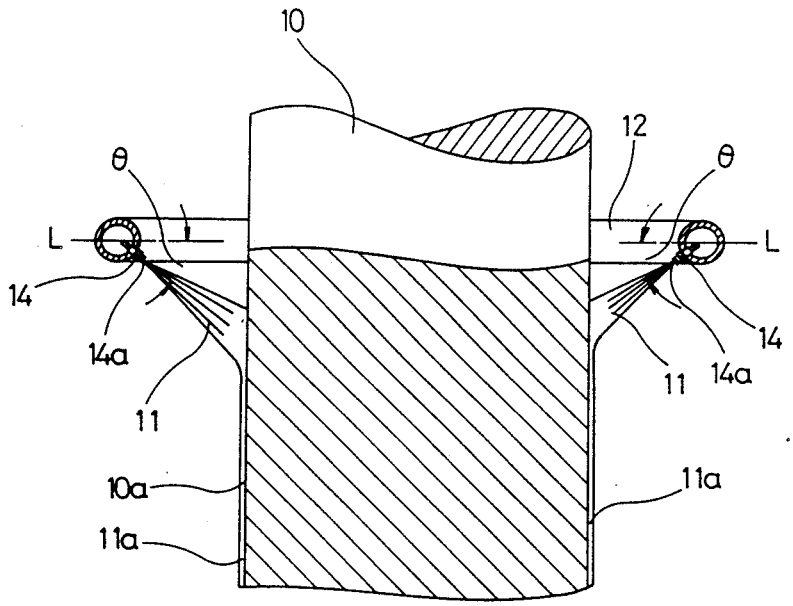
FIG. 4 is a sectional view taken along line A—A in FIG. 2 and viewed in the direction of arrows.

Referring now to FIGS. 2, 3 and 4, reference numeral 10 designates a graphite electrode. The graphite electrode 10, like the graphite electrode 2 shown in FIG. 1, has its upper end held by an electrode holder, and a lower graphite electrode is connected via a nipple to the lower end of the graphite electrode 10. The lower graphite electrode extends into an electric arc furnace through a cover thereof. In FIGS. 2, 3 and 4, particularly FIGS. 3 and 4, however, the electrode holder, furnace cover, nipple and lower graphite electrode are not shown. Further, in practice three graphite electrodes are disposed as graphite electrode 10 in the electric arc furnace at a uniform interval on a circle concentric with the furnace and having a predetermined radius. The three graphite electrodes are provided because a three-phase AC power source is used. In FIGS. 2, 3 and 4, only a typical one of these graphite electrodes 10 are shown. Lower graphite electrodes are each connected to each of the three graphite electrodes 10, and they are energized in the furnace to effect steelmaking or like melting and/or refining of metal.

Liquid coolant 11, e.g., one substantially consisting of water, is blown continuously against the outer periphery 10*a* of at least one of the three graphite electrodes 10, more particularly the outer periphery 10*a* of a portion of graphite electrode 10 extending between the holder and furnace cover. The liquid coolant 11 is jet not in the horizontal direction but in a downwardly inclined direction at an angle of 10° to 35° C. with respect to the horizontal.

The graphite electrode 10 may cooled when the liquid coolant 11 is jet in any direction so long as the coolant is blown against the outer periphery 10*a* of the graphite electrode 10. However, if the coolant 11 is jet substantially in a horizontal direction L—L to be blown against the outer periphery 10*a* of the graphite electrode 10, a high impact force is produced as it strikes the outer periphery, so that a considerable proportion of it is spattered to the outside. In this case, the graphite electrode outer periphery 10*a* may be cooled only locally for its portion, which is struck by the liquid coolant 11. Further, the spattered liquid coolant causes early wear of the electrode holder and furnace cover.

In order to solve this problem, according to the invention a cooling ductline 12 is disposed such that it substantially surrounds the graphite electrode 10, and the liquid coolant 12 introduced into the cooling ductline 12 through an inlet ductline 12*a* is jet in a downwardly inclined direction at an angle $\theta$ of 10° to 35° C. with respect to the horizontal L—L to be blown against the graphite electrode outer periphery 10*a*. The cooling ductline 12 is disposed between the electrode holder holding the outer end of the graphite electrode 10 and top cover of the electric arc furnace, preferably right under the electrode holder.

The cooling ductline 12 is in a ring-like form concentric with the graphite electrode 10 and disposed such that it is spaced apart a predetermined distance from the graphite electrode outer periphery 10*a*. Actually, however, the cooling ductline 12 has a gap 13 formed by removing at least a portion of it.

In an electric arc furnace, in which three graphite electrode 10 with respective lower graphite electrodes, each corresponding to each phase of a three-phase power source, are disposed on a circle concentric with it, the cooling ductlines 12 surrounding the respective graphite electrodes 10 are electromagnetically influenced either solely or mutually by the currents flowing through the graphite electrodes 10 and lower graphite electrodes connected thereto if the cooling ductlines 12 are perfectly ring-like. The individual graphite electrodes 10 are electromagnetically mutually influenced. This influence is also received by the cooling ductlines 12. If the cooling ductlines 12 perfectly ring-like, currents are caused to flow them. These currents electromagnetically affect the currents through the graphite electrodes 10, so that the operation of the electric arc furnace is impeded.

To eliminate the electric influence on the cooling ductlines 12, each thereof is provided in the cooling ductline 12, no current is induced in the cooling ductline 12 irrespective of electromagnetic influence thereon of the own associated graphite electrode 10 and the other graphite electrodes 10, and the furnace operation is never impeded.

The cooling ductline 12 is made of a material, which is not electromagnetically influenced and has excellent oxidization-proof property as well as having excellent molding and machining properties. For example, it is suitably made of stainless steel as non-magnetic material of a metal is to be used from the standpoint of the molding and machining properties. It may also be made of a non-metal material so long as the material is not electromagnetically influence and has excellent oxidization property such as ceramics.

Figure 5:
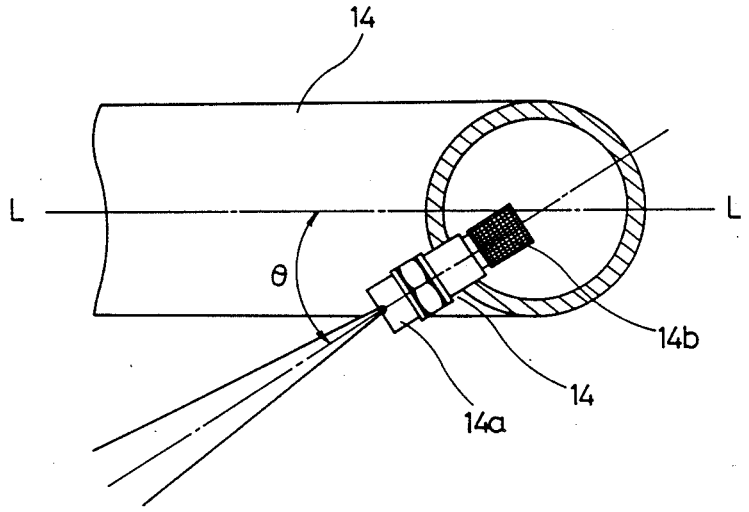
FIG. 5 is a view, to an enlarged scale, showing a jet nozzle mounting section of a ring-like cooling ductline shown in FIG. 4.

To cooling ductline 12 is provided with a plurality of suitably spaced-apart jet nozzles 14 directed toward the graphite electrode 10 for jetting the liquid coolant 11 blown thereagainst. Each jet nozzle 14 is directed toward the axis of the graphite electrode 10. As shown in FIGS. 4 and 5, the outlet 14*a* of each of jet nozzle 14 is directed in a downwardly inclined direction at an angle $\theta$ 10° to 35° C. When the liquid coolant 11 is directed continuously in this angular range from each jet nozzle 14 of the cooling ductline 12, it is blown against the graphite electrode 10 in a downwardly inclined direction as shown in FIG. 3. In this case, the impact force produced when the liquid coolant 11 strikes the outer periphery 10*a* of the graphite electrode 10 is substantially reduced, so that the liquid coolant 11 is not substantially spattered. Besides, since the liquid coolant 11 is directed downwardly, a thin liquid coolant film 11*a* is formed on the graphite electrode outer periphery 10*a*. While this liquid coolant film 11*a* flows down the graphite electrode outer periphery 10*a*, the liquid coolant 11 is evaporated by heat inside the graphite electrode 10. The heat retained in the graphite electrode 10 is robbed by the heat of evaporation, so that the graphite electrode 10 is cooled satisfactorily over its entire length. When the upper graphite electrode 10 is cooled in this way, the lower graphite electrode or electrodes connected to the upper one is cooled by the same, so that wear of the lower graphite electrode or electrodes due to oxidization can be suppressed. More specifically, since the graphite electrode has excelleent conductivity, when the upper graphite electrode held by the electrode holder is cooled, particularly over as greater portion of it as possible down to its lower end, the lower graphite electrode or electrodes connected to it are also satisfactorily cooled, so that it is possible to attain a great reduction of the electrode consumption.

The liquid coolant film 11*a* formed on the outer periphery 10*a* of the graphite electrode 10 held by the electrode holder partly enters the top cover of the electric arc furnace. The liquid coolant entering the furnace is evaporated if the temperature inside the furnace is very high and its quantity entering the furnace is not so large. In this case, the furnace operation is not cover is made of a refractory material, it the top cover is made of a refractory material, e.g., magnesia, it will swells by absorbing the moisture to result in undesired deterioriation of its brittleness. To eliminate this, the liquid coolant 11 is suitably jet under a pressure of 0.5 to 3 kg/cm$^2$ and at a rate of 0.8 to 6.0 l/min.

Generally, if the liquid coolant reaches a molt or the like under melting and/or refining operation in an electric arc furnace, its water content contacts the molt at a high termperature, so that very hazardous hydrogen explosion is liable. For this reason, in the prior art no cooling water or like liquid coolant is blown against the outer graphite electrode outer periphery 10*a*, but the upper graphite electrode held by the electrode holder is constructed as an internally water cooled non-consumable electrode, that is, it is constructed such that it has an axial coolant passage, the liquid coolant being introduced therethrough to cool it.

Where the liquid coolant is blown against the outer periphery 10*a* of the graphite electrode 10 as according to the invention, although it is desired to cool as large portion of the graphite outer periphery 10*a* as possible with liquid coolant 11, it is necessary to minimize the quantity of liquid coolant 11 to be blown so that coolant entering the top cover of the electric arc furnace is quickly evaporated in the furnace and thus eliminate the possibliity of the hazard noted above.

In the method of cooling graphite electrodes, in which only the upper one of a vertical succession of graphite electrodes connected to one another is cooled by blowing coolant instead of using any non-consumable electrode, the graphite electrodes are connected in the ordinary manner. Therefore, this method is best suited for the case where electrodes are connected on the site of operation. Further, the method is very excellent because it makes use of the fact that the upper and lower graphite electrodes are made of a very satisfactory heat conductor. However, the lower graphite electrode or electrodes are cooled by the upper one. This means that the effect of cooling of the lower graphite electrode or electrodes depends on the effect of cooling of the upper graphite electrode. In other words, the extent of reduction of the electrode consumption is determined by the extent, to which the upper graphite electrode is cooled in the length direction. By may of reference, it is said that even if only a portion, e.g., an upper end portion, of the upper graphite electrode is not red hot but is held black, it is possible to considerably suppress the wear of the outer periphery and end of the lower graphite electrode or electrodes due to oxidization. By way example, where the upper graphite electrode is cooled such that about 10% of its lenth is held black while the rest is red hot, the electrode consumption is said to be reduced b more than 12% owing suppression of the wear of the lower graphite electrode or electrodes due to oxidization.

Where the liquid coolant is blown in the downwardly inclined direction as noted above against the outer periphery of the upper graphite electrode, a liquid coolant film is formed on and flows down the graphite electrode outer periphery. As the liquid coolant film flows down, it can cool a large portion of the graphite electrode outer periphery in the length direction thereof. In other words, more than 10% of the upper graphite electrode, against which the liquid coolant is blown, can be held black. This means that the electrode consumption can be greatly reduced.

Figure 7:
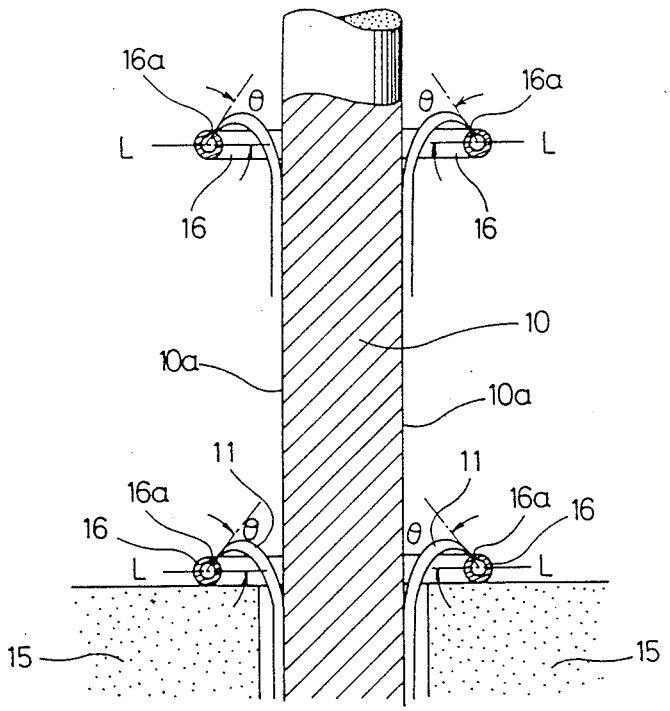
FIG. 7 is a sectional view showing a cooling device concerning a further embodiment of the invention.

FIG. 7 shows a modification of the cooling method. In this instance, a liquid coolant film is formed on the outer periphery 10*a* of the graphite electrode 10 by the liquid coolant jet in an upwardly inclined direction (at an angle $\theta$ of 10° to ±° C. with respect to the horizontal) and blown against the outer periphery 10*a* after drawing an arch. With this arrangement, it is possible to blow liquid coolant 11 without loss against the graphite electrode outer periphery 10*a*. Therefore, even where the top cover 15 of the electric arc furnace is made of magnesia or like refractory material, which becomes fragile by absorbing moisture, substantially no liquid coolant 11 reaches the top cover 15, so that there is no possibility of impeding the furnace operation. Further, where the top cover 15 is made of alumina or like refractory material having high durability with respect to moisture, with liquid coolant 11 jet in the upwardly inclined direction as noted above to be blown without loss, the like of the top cover 15 may be improved to 1.5 to 2.0 times or more in comparison to the case where the liquid coolant 11 is jet in the downwardly inclined direction.

Figure 6:
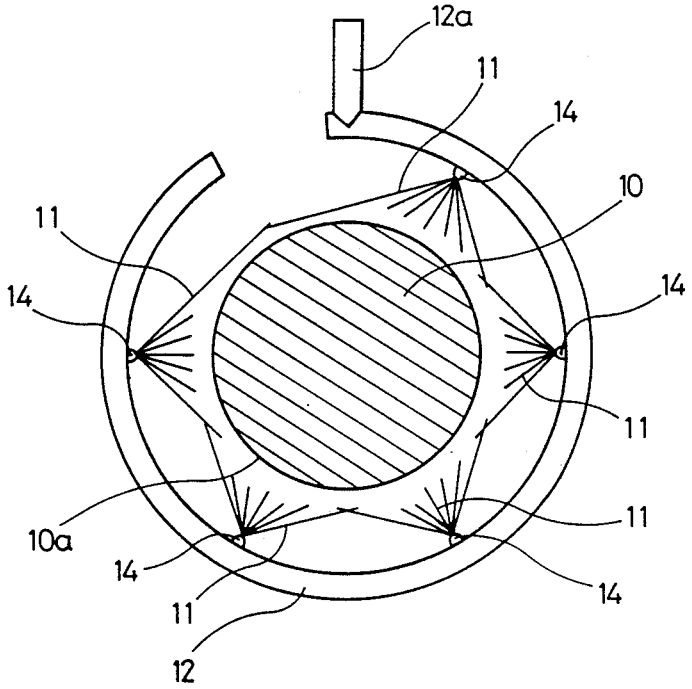
FIG. 6 is a plan view showing a cooling device concerning a different embodiment of the invention.

Further, while the cooling ductline 16 for jetting the liquid coolant 11 in the upwardly inclined direction may be provided with jet nozzles as shown in FIG. 7, usually it may be provided with at least one jet outlet or port 16*a* directed in an upwardly inclined direction in an inclination range of angle $\theta$=10° to 35° C. with respect to the horizontal. This cooling ductline 16, like the cooling ductline 12 shown in FIGS. 2 and 6, has a gap (which is not shown in FIG. 7). Further, at the time of the cooling the cooling ductline 16 may be disposed on the surface of the cover 15, although of course it may be disposed right under the electrode holder holding the graphite electrode 10.

The cooling ductline 12 or 16 noted above is suitably arranged such that the outlet 14*a* of the jet nozzles 14 or jet outlet or outlets 16*a* is spaced apart 5 to 20 cm from the outer periphery 10*a* of the graphite electrode 10. Suitably, the jet nozzle 14 or jet outlet 16*a* is arranged such that the liquid coolant 11 is jet in an inclination angle range of $\theta$=10° to 35° C. with respect to horizontal (see FIGS. 5 and 7), and the liquid coolant 11 is jet under a pressure of 0.5 to 3 kg/cm$^2$ and at a range of 0.8 to 6.0 l/min. When these conditions of the jet are met, the liquid coolant 11 can satisfactory cool the outer periphery 10*a* of the graphite electrode 10 without substantially spattered onto the electrode holder or top cover, irrespective of slight variation of the size, dimensions and capacity of the electric arc furnace so long as the furnace is of the type currently in practical use. It is thus possible to greatly improve the life of the graphite electrode 10.

For downwardly inclining the jet nozzle 14 in the inclination range of angle $\theta$ of 10° to 35° C. (see FIG. 5) to blow the liquid coolant, there is further reason in addition to those noted above. Where the inclination angle is 0° C. so that the liquid coolant 11 is jet from the jet nozzle 14 substantially in the horizontal direction L—L the graphite electrode 10 can be cooled only locally, i.e., it can be held black only for about 5% of its length, unless the quantity of liquid coolant 11 supplied is greatly increased. Besides, as the liquid coolant 11 is blown, its considerable portion is spattered toward and liable to cause damage to the electrode holder. For this reason, the lower limit of the inclination angle range is set to 10° C. If the inclination angle $\theta$ exceeds 35° C., on the other hand, the liquid coolant 11 is spreade as it is jet, so that is partly reaches the top cover of the electric arc furnace, thus leading to early wear of the top cover.

Further, if the upward inclination angle $\theta$ of the jet outlet 16*a* (see FIG. 7) is outside the range of 10° to 35° C., a satisfactory downwared arch of the jet liquid coolant 11 is not formed, and the spattered portion of the liquid coolant 11 is extremely increased.

As the liquid coolant 11 may be used ordinarily available supply water. However, the liquid coolant 11 may contain an oxidation resistant agent, i.e., calcium phosphate. When a liquid coolant containing an oxidation risistant agent is condensedly attached to and forms an oxidation resistant agent film on the outer periphery 10*a* of the graphite electrode 10. The oxidation resistant agent film thus formed promotes the prevention of the wear of the graphite electrode from the outer periphery therof due to the oxidization. When the upper graphite electrode with an oxidation resistant agent film formed on its outer periphery is used as lower graphite electrode, the wear of graphite electrode from the outer periphery thereof due to oxidization can be more effectively suppressed to further reduce the electrode consumption. To attain this effect, the oxidation resistant agent is suitably incorporated by 1 to 1.5% by weight.

Where the liquid coolant is jet in downwardly inclined direction, the jet outlet 14*a* of the jet nozzle 14 suitably has such a construction that the liquid coolant 11 strikes the outer periphery 10*a* of the graphite electrode 10 substantially uniformly, as shown in FIG. 2. As a suitable example, the jet nozzle 14 may be provided with a filter 14*b* to filter out dust and other foreign particles contained in the liquid coolant 11 (see FIG. 5). Further, where the liquid coolant is jet in an upwardly inclined direction as shown in FIG. 7, each jet outlet 16*a* is again suitably constructed such that the liquid coolant 11 strikes the graphite electrode outer periphery 10*a* substantially uniformly.

Further, in the case of FIG. 2, the cooling ductline 12 has a symmetrical arrangement with respect to the gap 13. However, it is possible to provide the gap 13 in any desired portion of the cooling ductline. For example, it is possible to provide the gap 13 in the neighborhood of the inlet ductline 12 can be very readily machined. The cooling ductline 16 as shown in FIG. 7, likewise, may have a gap provided in any desired portion.

EXAMPLE 1

Various samples of graphite electrodes as in Table 1 used to refine scrap by electric arc heating in an electric arc furnace. In each sample, the upper graphite electrode was holder, and it was cooled by blowing liquid coolant 11 jet in the downwardly inclined direction from the jet nozzles 14*a* of the cooling ductline 14 as shown in FIGS. 2 and 3. Supply water was used as the liquid coolant, and it was supplied continuously to be blown from the jet nozzles 14 against the outer periphery 10*a* of the graphite electrodes 10. As contrast, electric arc refining was conducted under the same conditions except for that no cooling water was blown. The electrode consumption was obtained in the case of the contrast and in the case of the invention the improvement was as in Table 1.

TABLE 1

| Sample No. | Size of graphite electrode (inch) | Contrast | Invention | Improvement |
|---|---|---|---|---|
| 1 | 20 | 2.8 kg/t | 2.5 kg/t | 11% |
| 2 | 20 | 2.9 kg/t | 2.4 kg/t | 17% |
| 3 | 20 | 2.6 kg/t | 2.3 kg/t | 15% |
| 4 | 20 | 2.7 kg/t | 2.2 kg/t | 19% |
| 5 | 18 | 3.0 kg/t | 2.6 kg/t | 13% |

This cooling ductline 11 was disposed right under the electrode holder. The distance between the graphite electrode outer periphery 10*a* and jet nozzle 14 was set to 15 to 20 cm, the downward inclination angle $\theta$ of the jet nozzle 14 was set to be in a range of 10° to 35° C., and rate of supply of the cooling water were set to be in respective ranges of 1 to 3 kg/cm$^2$ and 1 to 2 l/min. The number of jet nozzles were varied from 4 to 8.

The improvement as shown in Table 1, was at least 11%. No hazardous hydrogen explosion due to cooling water took place.

In the case of Sample 4, a high load operation using UHP electrodes was conducted. In this case, a very great improvement of 19% could be obtained. When cooling water is blown according to the invention, the graphite electrodes could be switched over to ordinary graphite electrodes.

Further, the same test as above was conducted except for that 10% by weight of calcium phosphate was uniformly mixed in the cooling water. The incorporated calcium phosphate remained in the form of a thin white film on the electrodes to greatly improve the oxidation resistant property. Consequently, the improvement was increased by 1 to 2% compared to each case in Table 1, indicating that it was possible to further reduce the cost for graphite electrodes.

Furthermore, for the sake of comparison the same test as above except for that the cooling water was jet at an inclination angle $\theta$ of 0° C. (i.e., in the horizontal direction) under a pressure of 1 to 3 kg/cm$^2$ and at a rate of 1 to 2 l/min. In this case, the improvement with respect to the contrast was 5 to 8%. Also in this case, a considerable proportion of the cooling water was spattered onto the electrode holder, making it very difficult to actually continue the operation.

EXAMPLE 2

The same test as in Example 1 was conducted except for that the cooling water 11 was jet in an upwardly inclined direction so that it was blown against the graphite electrode outer periphery 10*a* after drawing a downward arch. The improvement with respect to the contrast in Example 1 was as shown in Table 2.

TABLE 2

| Sample No. | Size of electrode Used (inch) | contrast | Invention | Improvement |
|---|---|---|---|---|
| 6 | 20 | 2.8 kg/t | 2.4 kg/t | 14% |
| 7 | 24 | 2.2 kg/t | 1.7 kg/t | 23% |
| 8 | 16 | 2.9 kg/t | 2.5 kg/t | 14% |

In this cases of Samples 6 and 8 a top cover made of a refractory material based on magnesia was used, while in the case of Sample 7 a top cover of a refractory material based on alumina was used.

When the cooling water was jet in the downwardly inclined direction as in Example 1, the life of an alumina refractory top cover was about 150 unit charges each taking about 2 hours as in the ordinary operation. In the case of Sample 7, however, the life was greatly extended from about 150 unit charges to about 600 unit charges i.e., by about 450 unit charges.

INDUSTRIAL UTILITY

As has been described in the foregoing, according to the invention, in the method of melting and/or refining metal by blowing a liquid coolant against the outer periphery of the upper one of a vertical succession of graphite electrodes connected to one another via nipples, the liquid coolant is jet in a downwardly or upwardly inclined direction at an angle of 10° to 35° C. with respect to the graphitge electrode outer periphery, it flows down the same without being substantially spattered, and it forms a liquid coolant film as it flows down. The graphite electrode outer periphery thus is cooled over its entire length by the liquid coolant film. Particularly, when the liquid coolant is jet in an upwardly inclined direction, it is brought into contact with the graphite electrode after drawing a downward arch, so that a liquid coolant film can be formed without substantial spattering of the liquid coolant. It is thus possible to eliminate or reduce damage to and wear of the electrode holder and top cover. Further, life improvement can be obtained even if the top cover is made of a refractory material based on magnesia.

Further, by blowing the liquid coolant against graphite electrode for melting and/or refining metal, great reduction of the electrode consumption can be obtained in general metal refinement including steel-making.

What is claimed is:

1. A method of melting and/or refining metal by using an electric arc furnace having a vessel for melting and/or refining said metal, a furnace cover covering an upper open portion of said vessel, a vertical succession of graphite electrodes extending into said vessel through said furnace cover and an electrode holder for holding an upper end portion of an upper electrode of said vertical succession of graphite electrodes, said method comprising:

jetting a liquid coolant against an outer peripheral portion of said upper electrode extending between said furnace cover and said electrode holder while directing the jetted liquid coolant in a downwardly inclined direction at an angle of 10°–35° with respect to the horizontal.

2. A method according to claim 1, wherein said liquid coolant is water.

3. A method according to claim 1, wherein said liquid coolant contains an oxidation resistant agent with the remainder being substantially water.

4. A method according to claim 1, wherein said liquid coolant is jetted under a jet pressure of 0.5 to 3 kg/cm$^2$ and at a jet rate of 0.8 to 6.0 l/min.

5. A method of melting and/or refining metal by using an electic arc furnace including a vessel for melting and/or refining said metal, a furnace cover covering an open upper portion of said vessel, a vertical succession of graphite electrodes extending into said vessel through said furnace cover and an electrode holder for holding an upper end portion of an upper electrode of said vertical succession of said graphite electrodes, said method comprising:

jetting a liquid coolant against an outer peripheral portion of said upper electrode extending between said furnace cover and said electrode holder with said liquid coolant being jetted in an upwardly inclined direction at an angle of 10°–35° with respect to the horizontal.

6. A method according to claim 5, wherein said liquid coolant is water.

7. A method according to claim 5, wherein said liquid coolant contains an oxidation resistant agent with the remainder being substantially water.

8. A method according to claim 5, wherein said liquid coolant is jetted under a jet pressure of 0.5 to 3 kg/cm$^2$ at a jet rate of 0.8 to 6.0 l/min.

9. A device for cooling a graphite electrode of an electric arc furnace for melting and/or refining metal comprising:

a cover for said electrode arc furnace having an opening through which the graphite electrode extends, an electrode holder holding an upper end portion of the graphite electrode and surrounding the outer periphery of said upper end portion, said cooling ductline extending substantially about the electrode with closed ends being spaced apart to form a gap with said cooling ductline being provided with at least one jet nozzle directed toward the axis of said graphite electrode in a downwardly inclined direction at an angle of 10°–35° with respect to the horizontal and supply means for supplying a liquid coolant to said cooling ductline under pressure so that the liquid coolant will be jetted from said cooling ductline against the outer periphery of said graphite electrode.

10. A device for cooling a graphite electrode of an electric arc furnace for melting and/or refining metal comprising:

a cover for said electrode arc furnace having an opening through which the graphite electrode extends, an electrode holder holding an upper end portion of the graphite electrode and surrounding the outer periphery of said upper end portion, said cooling ductline extending substantially about the electrode with closed ends being spaced apart to form a gap with said cooling ductline being provided with at least one jet nozzle directed toward the axis of said graphite electrode in a upwardly inclined direction at an angle of 10°–35° with respect to the horizontal and supply means for supplying a liquid coolant to said cooling ductline under pressure so that the liquid coolant will be jetted from said cooling ductline against the outer periphery of said graphite electrode.

* * * * *